US010641463B2

(12) United States Patent
Rasmussen

(10) Patent No.: US 10,641,463 B2
(45) Date of Patent: May 5, 2020

(54) MOVING HEAD LIGHT FIXTURE WITH ILLUMINATING SPHERICAL SHAPED HEAD AND YOKE

(71) Applicant: Harman Professional Denmark ApS, Aarhus N (DK)

(72) Inventor: Niels Jorgen Rasmussen, Egaa (DK)

(73) Assignee: Harman Professional Denmark ApS, Aarhus N (DK)

( * ) Notice: Subject to any disclaimer, the term of this patent is extended or adjusted under 35 U.S.C. 154(b) by 0 days.

(21) Appl. No.: 16/463,581

(22) PCT Filed: Oct. 20, 2017

(86) PCT No.: PCT/DK2017/050347
§ 371 (c)(1),
(2) Date: May 23, 2019

(87) PCT Pub. No.: WO2018/095492
PCT Pub. Date: May 31, 2018

(65) Prior Publication Data

US 2019/0316762 A1 Oct. 17, 2019

(30) Foreign Application Priority Data

Nov. 24, 2016 (DK) ..... 2016 70934

(51) Int. Cl.
*F21V 21/00* (2006.01)
*F21V 14/02* (2006.01)
(Continued)

(52) U.S. Cl.
CPC ..... *F21V 14/02* (2013.01); *F21V 3/02* (2013.01); *F21V 3/049* (2013.01); *F21V 21/30* (2013.01);
(Continued)

(58) Field of Classification Search
CPC ..... F21V 14/02; F21V 21/30; F21V 23/003; F21Y 2113/17; F21W 2131/406
(Continued)

(56) References Cited

U.S. PATENT DOCUMENTS 6,416,195 B1 * 7/2002 Lin ..... F21S 10/02 362/275
7,303,327 B2 * 12/2007 Copeland ..... F21S 8/035 362/271
(Continued)

FOREIGN PATENT DOCUMENTS

WO 2011131200 A1 10/2011
WO 201306029 A1 5/2013

*Primary Examiner* — Laura K Tso
(74) *Attorney, Agent, or Firm* — Angela M. Brunetti

(57) ABSTRACT

The present invention relates to a moving head light fixture comprising a base, a yoke and a head. The yoke is rotatable in relation to the base around a yoke axis. The head is rotatable around a head axis in relation to the yoke and comprises at least one beam light source arranged in the head housing where the beam light source generates a light beam exiting the housing. A part of the head housing and/or the said yoke shell is illuminated at least one pixel light source and form an illuminating part formed in a transparent material allowing light from the pixel light source to pass through the illuminating part and the illuminating part is substantially rotational symmetric in relation to said yoke axis. A plurality of such moving head can from a graphical display.

16 Claims, 10 Drawing Sheets

(51) Int. Cl.

| | |
|---|---|
| ***F21V 3/02*** | (2006.01) |
| ***F21V 3/04*** | (2018.01) |
| ***F21V 21/30*** | (2006.01) |
| ***F21V 23/00*** | (2015.01) |
| *F21Y 113/17* | (2016.01) |
| *F21W 131/406* | (2006.01) |

(52) U.S. Cl.
CPC ..... *F21V 23/003* (2013.01); *F21W 2131/406* (2013.01); *F21Y 2113/17* (2016.08)

(58) Field of Classification Search
USPC .. 362/231, 249.01, 249.09, 249.1, 269, 271, 362/272, 275, 372, 285, 287
See application file for complete search history.

(56) References Cited

U.S. PATENT DOCUMENTS

| | | | | |
|---|---|---|---|---|
| 8,801,225 | B2 * | 8/2014 | Dalsgaard | F21V 21/30 362/249.1 |
| 9,315,144 | B2 * | 4/2016 | Li | B60Q 1/24 |
| 2005/0047142 | A1 * | 3/2005 | Lui | B60Q 1/245 362/275 |
| 2013/0033865 | A1 | 2/2013 | Vinther et al. | |
| 2014/0204218 | A1 * | 7/2014 | Gebhard | F21V 21/30 348/164 |
| 2014/0340894 | A1 * | 11/2014 | Chien | F21V 5/04 362/235 |
| 2015/0049494 | A1 * | 2/2015 | Wang | F21V 31/00 362/372 |
| 2015/0070897 | A1 | 3/2015 | Chien | |
| 2016/0209013 | A1 | 7/2016 | Chien | |
| 2017/0038043 | A1 * | 2/2017 | Nakamura | G06F 3/017 |

* cited by examiner

MOVING HEAD LIGHT FIXTURE WITH ILLUMINATING SPHERICAL SHAPED HEAD AND YOKE

FIELD OF THE INVENTION

The present invention relates to a moving head light fixture comprising a base, a yoke and a head. The yoke is rotatable in relation to the base around a yoke axis. The head is rotatable around a head axis in relation to the yoke and comprises at least one beam light source arranged in the head housing where the beam light source generates a light beam exiting the housing.

BACKGROUND OF THE INVENTION

In order to create various light effects and mood lighting in connection with concerts, live shows, TV shows, sport events or as a part of an architectural installation light fixtures creating various effects are getting more and more used in the entertainment industry. Typically entertainment light fixtures creates a light beam having a beam width and a divergence and can for instance be wash/flood fixtures creating a relatively wide light beam with a uniform light distribution or it can be profile fixtures adapted to project image onto a target surface.

Typically such light fixtures comprises a least one light source generating a light beam propagating along an optical axis and an optical assembly configured to project the light beam along the optical axis. Light fixtures for entertainment can comprise a number of light effect components which is configured to be inserted into the light beam in order to provide different light effects. The light effect components can for instance be any light effects known in the art of intelligent/entertainments lighting for instance a CMY color mixing system, color filters, gobos, animation effects wheels, a iris diaphragms, a focus lenses, zoom lenses, prism effect components, framing e systems or any other light effects known in the art.

Light designers and programmers want as many effects as possible in a light fixture as this give the light designer and programmers many options when creating light shows. Additionally light designers and programmers constantly desire to have new light effects which can be used to create light shows.

EP2561273 discloses a moving head light fixture comprising a base; a yoke connected rotatable to the base and a head connected rotatable to the yoke. The head comprises a number of light sources and a number of light collecting means arranged in the head, the number of light collecting means collect light from at least one of the light sources and converts the collected light into a number of source light beams emitted from the head. The head comprises a diffuser cover having at least one non-diffusing region where through at least a part of the of source light beams pass without being diffused and a least one diffuser region, where the diffuser region receives and diffuses at least a part of said light generated by the light sources. At least a part of the diffuser cover protrudes from the head and is configured to diffuse a part of the received light sideways and backwards in relation to the source light beams. The protruding diffuser cover will appear as a 3-dimensional illuminated object. This effect can be used in illumination systems where a large number of moving head light fixtures are set up in a matrix controlled by a central controller treating each moving head light fixture as pixel. Each moving head lighting fixture then act as a 3-dimentional pixel, which can be seen from many sides, however the visual appearance of such illumination systems depends on the orientation of the head and yoke of the moving head light fixtures.

US 2016/0209013 discloses An LED light has a built-in projection light and a night light to offer at least two functions for people in a dark environment. The projection light can project an image from any type of display-unit irrespective of geometric shape or image source or type, including display of digital data, wireless digital data, an LCD or TFT screen display, or any other display, enabling images of enlarged size to be projected onto a preferred surface, making it easier for people to see the image. The built-in night light helps people see things in a dark environment.

SUMMARY OF THE INVENTION

The object of the present invention is to provide a moving head light fixture and light effect system which reduces the limitations with the prior art moving heads light fixtures and light effect systems.

These limitations are reduced by a moving head light fixture comprising:

- a base;
- a yoke connected rotatable to the base, where at least one actuator rotates the yoke around a yoke axis, the yoke comprises at least one yoke shell configured to enclose at least one yoke element;
- a head connected rotatable to the yoke, where at least one actuator rotates the head around a head axis, the head comprises at least one beam light source arranged in a head housing, the beam light source generating a light beam exiting the head housing through a light beam window in the head housing;

wherein the moving head light fixture comprises at least one pixel light source configured to illuminate at least one of:

- a part of the inside of the head housing; and
- a part of the inside of the yoke shell;

wherein the parts of the head housing and the yoke shell which are illuminated by the pixel light source from an illuminating part formed in a transparent material allowing light from said pixel light source to pass through said illuminating part and where said illuminating part is substantially rotation symmetric in relation to said yoke axis.

Providing a moving head light fixture with a beam light source and a pixel light source makes it possible to use the moving head light fixture both as an illumination device providing an illumination outside the light fixture and providing a visual effect at the moving head light fixture itself. The illumination outside the light fixture is provided by using the beam light source which generates a light beam that is emitted through the light beam window in the head housing and thus can be used to generate illuminating effects outside the moving head light fixture. The visual effect of the moving head light fixture is provided by illuminating at least a part of the yoke shell or a part of the head housing from the inside using the pixel light source and forming the illuminated part of the head housing and/or yoke shell in a transparent material allowing at least a part of the light from the pixel light source to pass through the head housing and/or yoke shell. The parts of the head housing and/or the yoke shell illuminated from the inside will thus form an illuminating part, which appears as an illuminating object. The illuminating part of the moving head light fixture can be used as pixels in a light effect system where a plurality of such moving head light fixtures acts as a plurality of visual pixels where the plurality of visual pixels can form a graphical display.

Additionally the visual appearance of the moving head light fixtures can be combined with an illumination outside the light moving head light fixture generated by the beam light source, for instance as midair effects where the light beams are visible outside the light fixture. The midair effects can be generated by providing theatrical fog or haze into the air as the light from the light beam then are scattered by the fog/haze particles and thus are visible in midair. Additionally the illuminated transparent part of the head housing and/or the yoke shell is substantially rotation symmetric in relation to the yoke axis. Providing the illuminating part as substantially rotation symmetric in relation to the yoke axis results in the effect that and viewer observing the illuminating part will not be able to observe change in orientation of the illuminating part in relation to the yoke axis when the yoke and head rotates around the yoke axis. As a consequence the yoke and head can be rotated in relation to the yoke axis without the viewer observing a change to the illuminating part. In a dark environment the viewer will have even more difficulties observing any change in orientation of the yoke and head in relation to the yoke axis, as the illumination transparent part will be more apparent than non-illuminating parts of the moving head light fixture. This makes it possible to provide a light effect system where a plurality of such moving head light fixtures acts as a plurality of visual pixels and where the orientation of the yoke and head in relation to the yoke axis will not affect the visual appears of the visual pixels as seen by the viewer.

The result is that a light effect system comprising moving head light fixtures according to claim 1 can be used to create a dynamic visual image by controlling the pixel light sources using dynamic graphical content and in addition the head and yoke can be rotated without the viewer noticing this. Additionally the light beams can be used to create additional light effect to the graphical image formed by the moving head pixels. For instance the beam light source can be configured to appear at random intervals where the direction the light beam are randomly hanged between every appearance and where dynamic content still are displayed at the moving head pixels. It is also noticed that the light beams can be moved in a controlled manner. As a consequence a surprising light effect and visual effect can be provided.

The base of the moving head light fixture can be shaped in any way suitable for a moving head light fixture and can comprise means for mounting the moving head light fixture, a power supply unit, communication means to communicate with a light controller, an internal controller to control the components (other subsystems) in the moving head light fixture, etc. One should notice that the above mentioned components only serve as examples and that any of the above components can be fitted elsewhere in the moving head light fixture or outside of the moving head light fixture.

The yoke serves to provide a rotation around the yoke axis while the head serves to provide a rotation around the head axis. In one embodiment the yoke axis and head axis are perpendicular to each other. The yoke is typically u-shaped but can have any shape suitable for the application. The moving head light fixture comprises an actuator configured to rotate the yoke around the yoke axis and in and actuator configured to rotate the head around the head axis; it should be noted that the actuators can be placed anywhere suitable in the moving head light fixture. For instance the actuator rotating the yoke around the yoke axis can be arranged in the base or in the yoke, and the actuator rotating the head around the head axis can be arranged in the head or yoke.

The at least one pixel light source configured to illuminate the transparent part of the yoke shell and/or head housing can be any light source, including but not limited to, incandescent lamps, discharge lamps, plasma lamps, LEDs (light emitting diodes), OLEDs (organic LEDs), PLEDs (polymer LEDs), etc. or any combination thereof. It is also understood that any number of pixel light sources can be used. The transparent part of the yoke shell and/or head housing can be any material capable of either partly or completely allowing light emitted the light from the pixel light source to pass there through, including, but not limited to polymers or glass.

The beam light source, arranged inside the head of the moving head light fixture, can be any light source, including, but not limited to, incandescent lamps, discharge lamps, plasma lamps, LEDs, OLEDs, PLEDS, etc. or any combination thereof. It is also understood that any number of beam light sources can be used. The light beam window in the housing can be any component allowing the light beam to be emitted from the housing, including, but not limited to, optical lenses, clear glass, colored glass, openings, etc. or any combination thereof.

The illuminating part is substantially rotation symmetric in relation to the yoke axis meaning that the distance from the yoke axis to the outer surface of the illuminating part of at least 90% of the circumference around the yoke axis of the illuminating part is at least 90% of the maximum distance from the yoke axis to the outer surface of the illumination part at any cross section perpendicular to and along the yoke axis. As a consequence a viewer observing the moving head light fixture from a normal viewing distance will be unable to determine the orientation of the yoke and/or head in relation to the yoke axis based on the shape of the illuminating transparent part, where the normal viewing distance in theatrical or entertainment applications typical are between 10 and 100 meters. For instance the cross section of the illumination part perpendicular to the yoke axis may be slightly elliptical with a where the length of the semi-minor axis is 90% of the length of the semi-major and the yoke axis is positioned at the interception between the major and minor axis of the ellipse. However is to be understood cross section of the illuminating part may have other shapes.

Providing a moving head light fixture comprising the features described above makes it possible to provide a moving head light fixture which can provide a light beam as known in the prior art and where the moving head light fixture also can be used as an illuminating pixel independent of the projected light beam and the orientation of the yoke and head. If a plurality of the moving head light fixtures is combined, the pixel effect can be used to form a graphical display capable of showing graphical content using the illuminating part of each moving head light fixture as a pixel. The moving head light fixtures may be setup in a system capable of crating the graphical content based on a providing an image/video feed signal. And the light beams created by the beam light source of the moving light fixtures can be pointed in any direction around the yoke axis without distorting the graphical content created by the graphical display.

In one embodiment the transparent part of the head housing is substantially rotation symmetric in relation to the head axis. This results in the effect that the viewer observing the illuminated transparent part will not be able to observe change in orientation of the illuminated transparent part of the head when the head rotates around the head axis. As a consequence the head can be rotated in relation to the head axis without the viewer observing a change to the illuminating transparent part in relation to the head axis. In a dark environment the viewer will have even more difficulties observing any change in orientation of the head in relation to the head axis, as the illuminating part of the head will be more apparent than non-illuminating parts of the moving head light fixture. The illuminating part of the head is substantially rotation symmetric in relation to the head axis meaning that the distance from the head axis to the outer surface of the illuminating part of at least 90% of the circumference around the head axis of the illuminating part is at least 90% of the maximum distance from the head axis to the outer surface of the illumination part at any cross section perpendicular to and along the head axis. As a consequence a viewer observing the moving head light fixture from a normal viewing distance will be unable to determine the orientation of the head in relation to the head axis based on the shape of the illuminating transparent part, where the normal viewing distance in theatrical or entertainment applications typical are between 10 and 100 meters. For instance the cross section of the illumination part perpendicular to the head axis may be slightly elliptical with a where the length of the semi-minor axis is 90% of the length of the semi-major and the head axis is positioned at the interception between the major and minor axis of the ellipse. However is to be understood cross section of the illuminating part may have other shapes.

Similarly, the transparent part of the yoke shell can be substantially rotation symmetric in relation to the head axis. This results in the effect that the viewer observing the illuminated transparent part will not be able to observe how the moving head light fixtures are orientated in relation to the head axis as a consequence the moving head light fixtures heads not: be as accurately arranged orientated in relation to head axis. The illuminating part of the yoke is substantially rotation symmetric in relation to the head axis meaning that the distance from the head axis to the outer surface of the illuminating part of at least 90% of the circumference around the head axis of the illuminating part of the yoke is at least 90% of the maximum distance from the head axis to the outer surface of the illumination part at any cross section perpendicular to and along the head axis.

In one embodiment to the moving head light fixture the outer surface of the illuminating part of the head housing and the yoke shell form a continuous surface. As a consequence, a viewer will observe the illuminating part as a continuous illuminating pixel and will not be able to observer where the illuminating part of the head housing and the yoke shell meet. That the head housing and yoke housing form a continuous surface means that, at the areas near the transition between the head housing and yoke shell, the curvature of the outer surface of the head housing and yoke shell are the same. It is to be understood that an empty space between the head housing and yoke shell may be present, however outer contour of the parts neighboring each other has the same curvature.

In one embodiment at least a part of the illuminating part is shaped as part of a sphere, where the center point of the sphere is coincident with the yoke axis. The spherical shaped illuminating part can thus be rotated around the yoke axis without a viewer observing the illuminating part noticing the rotation of the spherical illuminating part in relation the yoke axis and the position of the observer along the yoke axis does not influence the appearance of the spherical shaped illuminating part. Similar in one embodiment at least a part of the illuminating part is shaped as part of a sphere, where the center point of the sphere is coincident with said head axis. The spherical shaped illuminating part can thus be rotated around the head axis without a viewer observing the illuminating part noticing the rotation of the spherical illuminating part in relation the head axis and the position of the observer along the head axis does not influence the appearance of the spherical shaped illuminating part. In one embodiment the illuminating part is shaped as a part of a sphere where the center point of the sphere is coincident with the intersection between the yoke axis and head axis.

In one embodiment the illuminating part is configured to scatter light received from the pixel light sources into many directions. The light from the pixel light sources can as a consequence be seen from many positions around the moving head light fixture and the illuminating part will appear as an illuminating surface. The illuminating part can be configured to scatter the received light by providing the transparent material with a rough or frosted surface which scatters the light when the light hits the rough or frosted surface. Alternatively, small particles can be embedded into the transparent material and the light can then be scattered by the small particles. The transparent material can thus comprise a frosted region which scatters the light and in addition makes it difficult for a viewer to see into the head housing or yoke shell when the pixel light source is not turned on. As a consequence, the frosted surface will appear a non-clear surface which make is difficult of the viewer to see the components inside the head and yoke.

In addition, a graphical display system is also provided. The graphical display system comprising a plurality of illuminating pixels and a control system configured to send pixel data to the plurality of illuminating pixels. The pixel data indicates the color of each of said illuminating pixels and the illuminating pixels are provided as a moving head light fixtures as described above. The control system is configured to send light effect parameters indicative of at least one beam effect parameter related to the light beam and at least one position parameter related to at least the position of the head and/or yoke. The control system can also comprises comprise a pixel controller configured to generate said pixel data and a light controller configured to generate said beam effect parameter and said position parameter. This makes is possible to provide a graphical display which can provide a dynamic display effect using the moving head light fixtures as pixels and at the same time combine the dynamic visual effect with midair effects created by the light beams, where the light beams can be directed in various directions without affecting the visual appearance of the dynamic display effects.

In addition a method of creating a visual effect is also provided. The method comprises at least one of steps:

- illuminating a part of the inside of said head housing of a moving head light fixture using a pixel light source; and
- illuminating a part of the inside of said yoke shell of a moving head light fixture using a pixel light source;
- generating midair in the air outside the moving head light fixture using a light beam light source;
- rotating the head around said head axis using an actuator; and
- rotating the yoke around said yoke axis using an actuator.

where the moving head light fixture corresponds the moving head light fixture as described previously. The method can also comprise a step of providing a plurality of the moving heads light fixtures and for at least some of said moving heads light fixture performing at least one of the above steps. The method makes it possible to provide a dynamic display effect using the moving head light fixtures as pixels and at the same time combine the dynamic visual effect with midair effects created by the light beams, where the light beams can be directed in various directions without affecting the visual appearance of the dynamic display effects.

DETAILED DESCRIPTION OF THE INVENTION

The present invention is described in view of exemplary embodiments only intended to illustrate the principles of the present invention. The skilled person will be able to provide several embodiments within the scope of the claims. In the illustrated embodiments the illustrated light beams and optical means do only serve to illustrate the principles of the invention rather than illustrating exact and precise light beams and optical means. Throughout the description the reference numbers of similar elements providing similar effects have the same last two digits.

Figure 1:
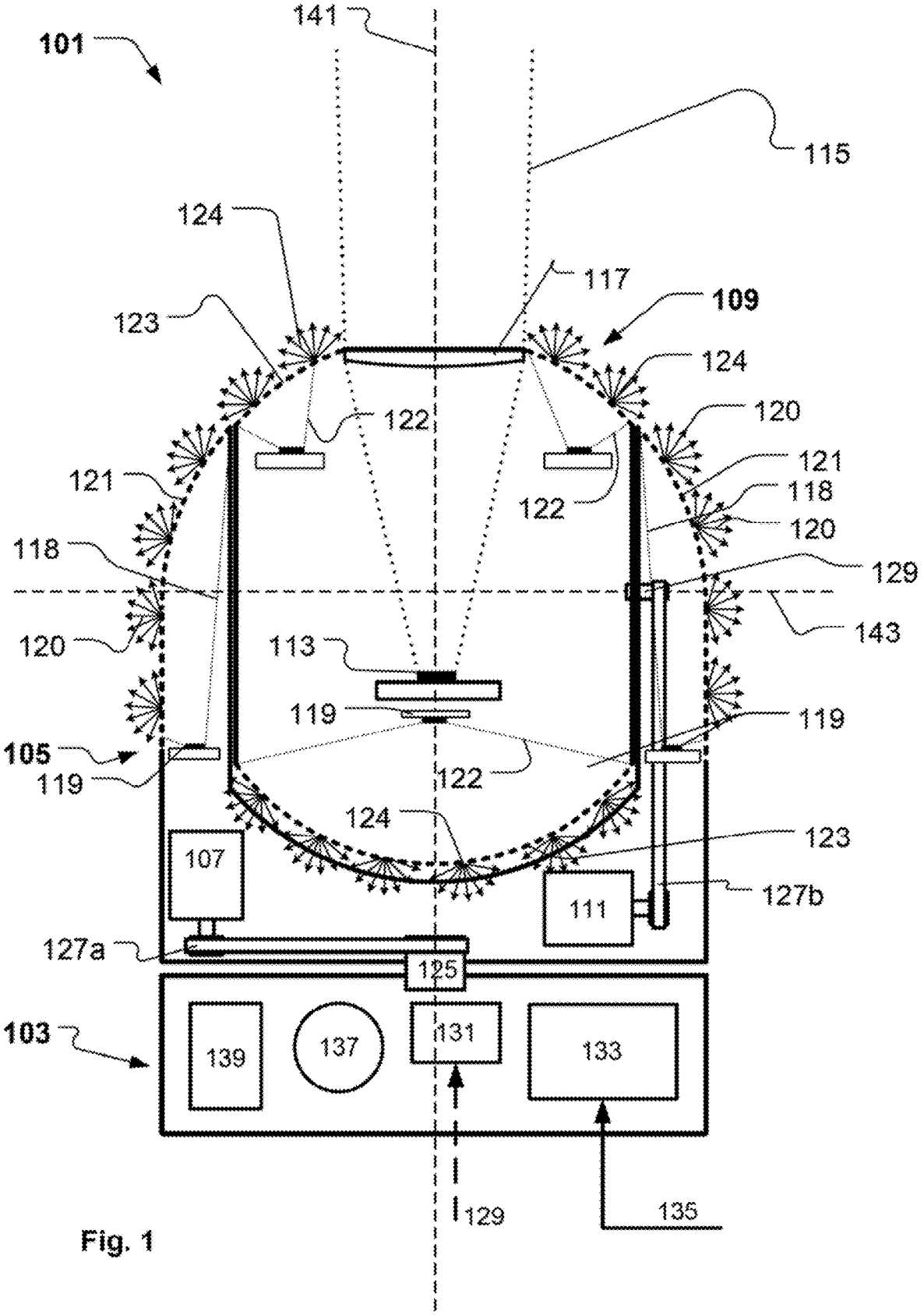
FIG. 1 illustrate, a simplified cross-sectional view of a moving head light fixture with a beam light source, a pixel light sources and illuminating parts.

FIG. 1 illustrates a structural diagram of a moving head light fixture 101 comprising a base 103, a yoke 105 rotatable around a yoke axis 141 in relation to the base by at least one actuator 107. In the illustrated embodiment the actuator is connected to a base shaft 125 through a belt 127*a*; however this is only an example, and the yoke can be connected to the base in many ways as known in the art of intelligent stage lighting for instance the actuator can be connected directly to the base shaft or through gearing. A head 109 is connected rotatable around a head axis 143 to the yoke and is rotatable in relation to the yoke by at least one actuator 111. In the illustrated embodiment the actuator 111 is connected to a yoke shaft 129 through a belt 127*b*; however this is only an example, and the head can be connected to the yoke multiple in ways as known in the art of intelligent stage lighting. The head housing comprises at least one beam light source 113 and the beam light source generates a light beam 115. The light beam exits the head housing through a light beam window 117 in the head housing. In the illustrated embodiment the light beam window is shown as an optical lens configured to deflect the light beam, however it is noticed that the light beam window can be provided as any component allowing the light beam 115 to propagate through the head housing, such as optical lenses, clear areas, or even an opening in the housing.

The yoke comprises a number of pixel light sources 119 configured to illuminate 118 at least a part of the yoke shell 121 and a part of the yoke shell is formed of a transparent material (illustrated in doffed lines) allowing at least a part of the light from the pixel light source to pass through the transparent parts of the yoke shell housing as illustrated by arrows 120. The transparent material also can be configured to scatter/diffuse the light hitting the transparent material in many directions; as a consequence the transparent parts of the yoke shell will appear as an illuminating part when illuminated by light from the pixel light sources 119.

The head comprises a number of pixel light sources 119 configured to illuminate 122 a pan of the head housing 123 and a part of the head housing is formed of a transparent material (illustrated in dotted lines) allowing at least a part of the light from the pixel light source to pass through the transparent parts of the head housing as illustrated by arrows 124. The transparent material also can be configured to scatter/diffuse the Light hitting the transparent material in many directions: as a consequence, the transparent parts of the head housing will appear as an illuminating part when illuminated by light from the pixel light sources 119.

The illuminating parts of the head housing and the yoke shell are substantially rotational symmetric in relation to the yoke axis 141. As illustrated in FIGS. 2-4 one advantage of forming the illuminating part of the head housing and yoke shell substantially rotational symmetric in relation to the yoke axis is the fact that The yoke and head can be rotated in relation to the yoke axis without the viewer observing a change to the illuminating part in relation to the yoke axis.

Additionally the illuminating part of the head housing is substantially rotational symmetric in relation to the head axis 143. As illustrated in FIGS. 2-4 one advantage of forming the transparent part of the head housing substantially rotational symmetric in relation to the head axis is the fact that the head can be rotated in relation to the head axis without the viewer observing a change to the illuminating transparent part in relation to the head axis.

The illuminating part of the yoke shell and head housing and the pixel light source allows the moving head light fixture to function as a pixel. As the moving head light fixture moves, the illuminating parts seems to remain static leaving the impression that the pixel is stationary. The moving head light fixture can thus be used as a pixel in a group of several similar moving head light fixtures creating a graphical display upon which graphical content can be shown. The light beam 115 can be used to enhance the experience by creating midair effects or similar effects as known in the art of stage lighting and the rotational symmetric illuminating parts allows the light beam to be directed in different directions without changing the visual appearance of the illuminating part of the head housing and yoke shell.

As known in the prior art the moving head light fixture receives electrical power 129 from an external power supply (not shown). The electrical power is received by an internal power supply 131 which adapts and distributes electrical power through internal powerlines (not shown) to the subsystems of the moving head. The internal power system can be provided in many different ways for instance by connecting all subsystems to the same power line. The skilled person will however realize that some of the subsystems in the moving head need different kind of power and that a ground line also can be used. The light source will for instance in most applications need different kind of power than the step motors and driver circuits.

The moving head light fixture also comprises a controller 133 which controls the components (other subsystems) in the moving head light fixture based on an input signal 135 indicative of light effect parameters, such as beam effect parameters, position parameters and other parameters related to the moving head lighting fixture. The beam effect parameters relate to the light effects that the light beam should generate and may for instance be color, dimming level, prism effects, gobo effects, iris effects animation effects etc. It is noticed eventual components generating these light effects have not been shown.

The controller receives the input signal from a light controller (not shown) as known in the art of intelligent and entertainment lighting for instance by using a standard protocol like DMX, ArtNet, RDM, Ethernet, or a video signal such as a HDMI, DVI MP4 etc. signal. The input signal is indicative of at least one beam effect parameter related to the light beam 115, at least one position parameter related to the position of the moving head light fixture and at least one pixel effect parameter related to the pixel light sources 119. The input signal can also be provided as two separate signals (not shown) one comprising light effect parameters related to the general control of the moving head light fixture like light beam effect parameters, lamp position parameters etc., and the other signal comprising the pixel effect parameters for the pixel sources for example as pixel data indicative of the color of the pixel light source in form of a video feed. It should be noted that the above is just examples of input signals, the input signal can be designed any way that fits for a moving head light fixture with pixel light sources. The controller is adapted to send commands and instructions to the different subsystems of the moving head through internal communication lines (not shown). The internal communication system can be based on a various type of communications networks/systems.

The moving head light fixture can also comprise user input means 137 enabling a user to interact directly with the moving head instead of a light controller to communicate with the moving head. The user input means can for instance be buttons, joysticks, touch pads, keyboard, mouse etc. The user input means can also be supported by a display 139 enabling the user to interact with the moving head light fixture through a menu system shown on the display using the user input means. The display device and user input means can in one embodiment also be integrated as a touch screen.

The pixel light source can comprise at least a red emitter configured to emit red light, a green emitter configured to emit green light and a blue emitter configured to emit blue light. The pixel light source can thus illuminate the head housing and the yoke shell with red, green and blue light which can be combined into many different colored by varying the intensity of the red, green and blue light in relation to each other as known in the art of additive color mixing. As a consequence the color of the illuminating parts of the head housing and toke shells can be varied.

In an alternative embodiment the non-illuminated parts of the yoke shell which are not illuminated by the pixel light source is provided in a clear transparent material allowing the viewer to observe the illuminating parts through the clear transparent of the non-illuminated parts of the yoke shell. As a consequence eventual visual blocking in relation to the illuminated parts of the moving head light fixture by non-illuminate part of the yoke can be reduced.

FIGS. 2*a*-2*i*, 3*a*-3*i*, 4*a*-4*i* illustrate different views of a moving head light fixture 201 where the yoke and head have been arranged in different positions. FIGS. 2*a*-2*i* illustrate top views, FIGS. 3*a*-3*i* illustrate perspective views and FIGS. 4*a*-4*i* illustrate side views.

The moving head light fixture 201 is similar to the moving head light fixture illustrated in FIG. 1 and comprises a base 203, yoke 205 and a head 209. The transparent parts illuminated by the pixel light sources (not shown in FIGS. 2*a*-2*i*, 3*a*-3*i*, 4*a*-4*i*) of the head housing and the yoke shell are illustrated as shaded areas. The emitting window 217 and light beam 215 also are illustrated. The head is rotatable around a head axis 243 (dashed-dotted line) and the yoke is rotatable around a yoke axis 241 (dashed line). For simplicity of the drawings the reference numbers related to the moving head light fixture 201, the base, 203, the yoke 205, the head, the light beam 215, head axis 243, yoke axis 241 yoke and the emitting window 217 only have been illustrated in FIGS. 2*b*, 3*b*, 4*b*.

The rotation of the head in relation to the yoke around the head axis is illustrated by arrows 247 and the angle of rotation is indicated besides the arrow. A head angle of 0 degrees corresponds to the position where the light beam is directed along the yoke axis and away from the yoke and base. In other word the light beam is directed straight upwards when the moving head light fixture is standing on the base. The light beam can be tilted by rotating the head in relation to the head axis The rotation of the yoke in relation to the base around the yoke axis is illustrated by arrows 249 and the angle of rotation is indicated besides the arrow. In the illustrated embodiment a yoke angle of 0 degrees corresponds to a position where the yoke arms are aligned with the sides of the base. The light beam can be panned by rotating the yoke in relation the yoke axis.

Figure 2A:
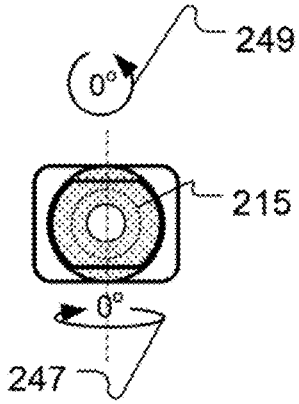
FIGS. 2*a*-2*i* illustrate top views of the moving head light fixture with the light beam positioned in 9 different directions.
Figure 2B:
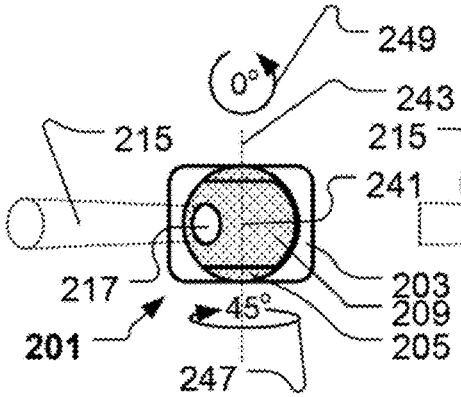
Figure 2C:
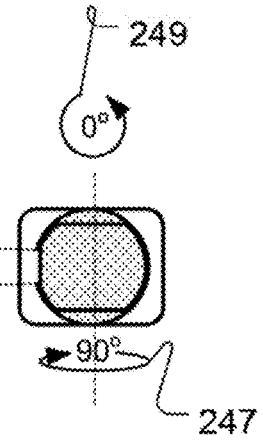
Figure 3A:
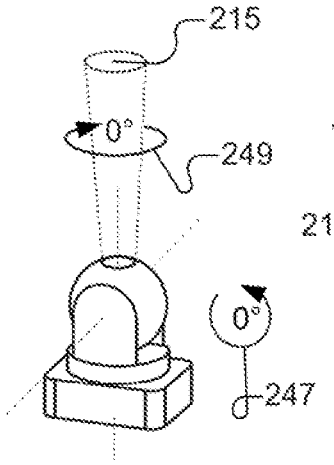
FIGS. 3*a*-3*i* illustrate perspective views of the moving head light fixture with the light beam positioned in 9 different directions.
Figure 3B:
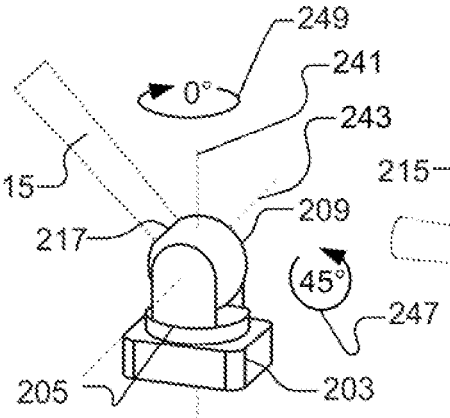
Figure 3C:
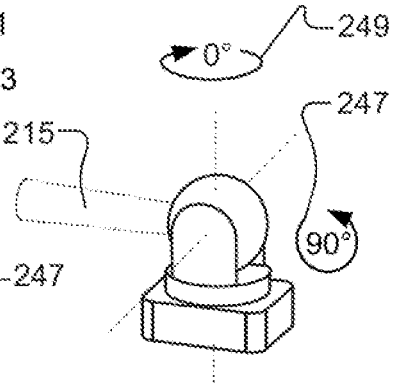
Figure 4A:
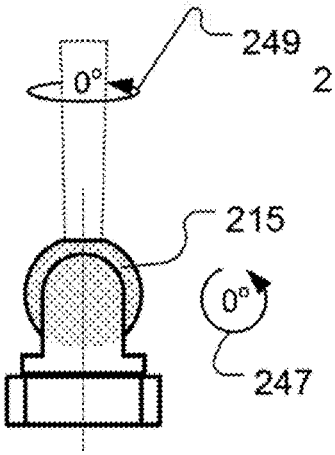
FIGS. 4*a*-4*i* illustrate side views of the moving head light fixture with the light beam positioned in 9 different directions.
Figure 4B:
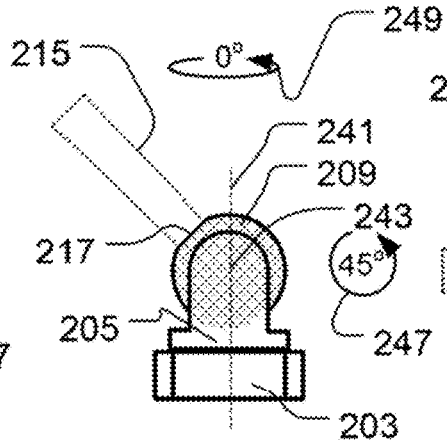
Figure 4C:
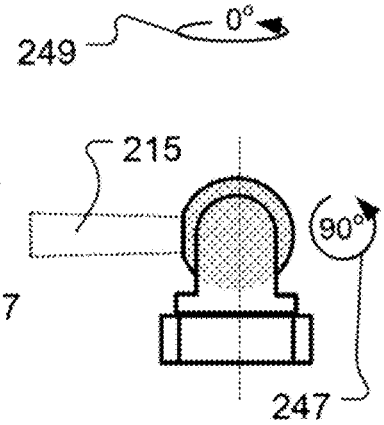

FIGS. 2*a*-2*c*; 3*a*-3*c* and 4*a*-4*c* illustrate the moving head light fixture with the yoke arranged at an yoke angle of 0 degrees and the head at different head angles, where in FIGS. 2*a*, 3*a* and 4*a* the head is positioned at a head angle of 0 degrees; in FIGS. 2*b*, 3*b* and 4*b* the head is positioned at a head angle of 45 degrees and in FIGS. 2*c*, 3*c* and 4*c* the head are positioned at a head angle of 90 degrees.

Figure 2D:
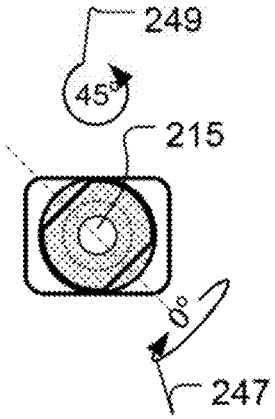
Figure 2E:
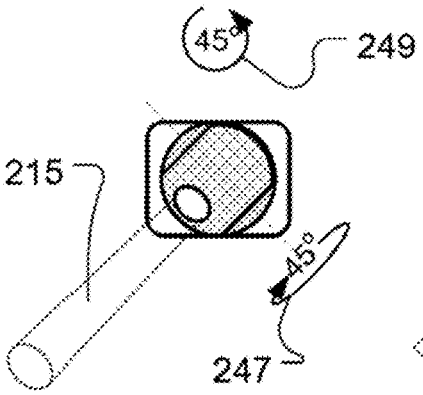
Figure 2F:
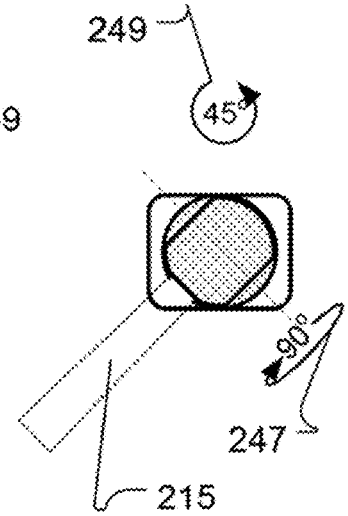
Figure 3D:
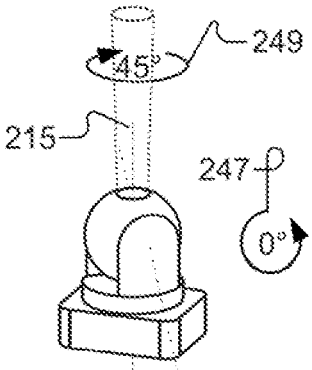
Figure 3E:
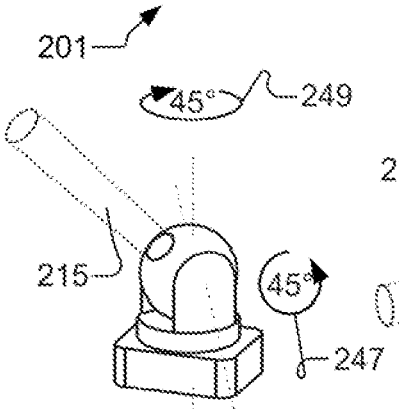
Figure 3F:
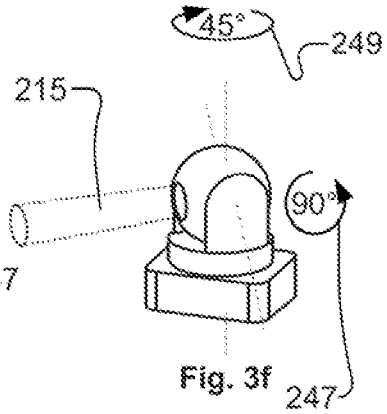
Figure 4D:
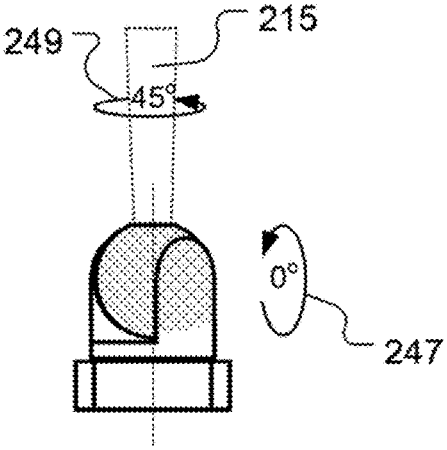
Figure 4E:
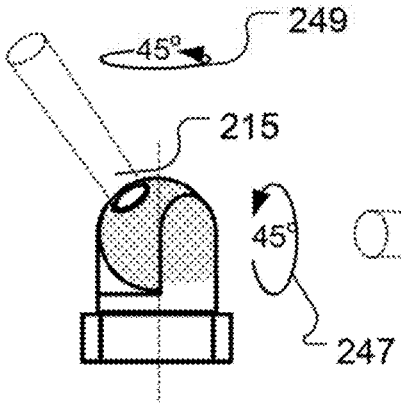
Figure 4F:
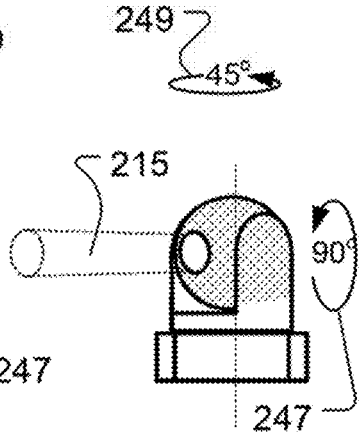

FIGS. 2*d*-2*f*; 3*d*-3*f* and 4*d*-4*f* illustrate the moving head light fixture with the yoke arranged at an yoke angle of 45 degrees and the head at different head angles, where in FIGS. 2*d*, 3*d* and 4*d* the head is positioned at a head angle of 0 degrees; in FIGS. 2*e*, 3*e* and 4*e* the head is positioned at a head angle of 45 degrees and in FIGS. 2*f*, 3*f* and 4*f* the head are positioned at a head angle of 90 degrees.

Figure 2G:
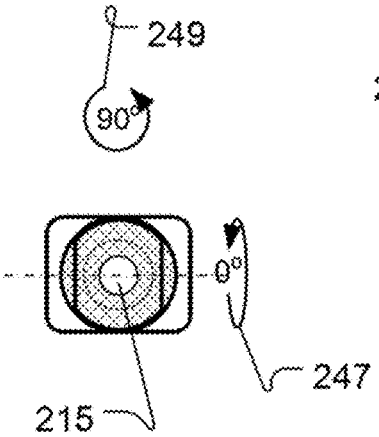
Figure 2H:
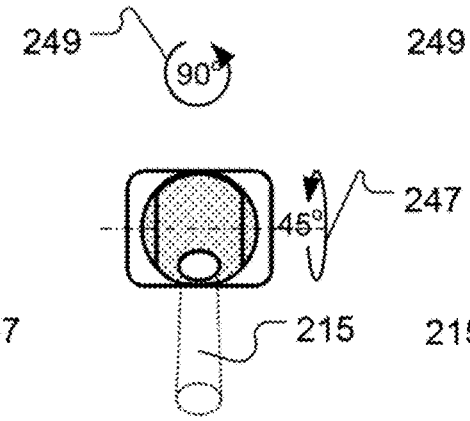
Figure 2I:
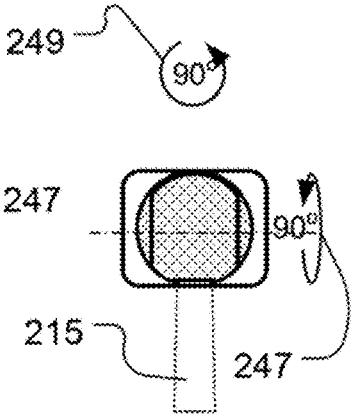
Figure 3G:
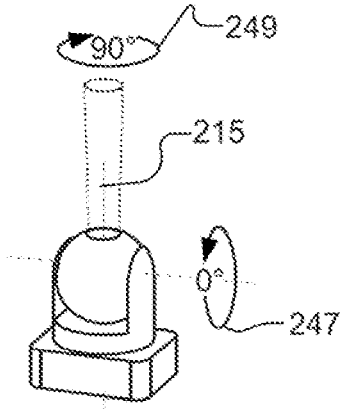
Figure 3H:
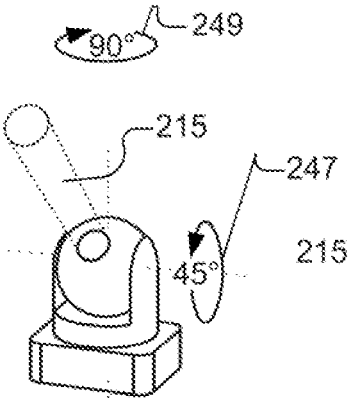
Figure 3I:
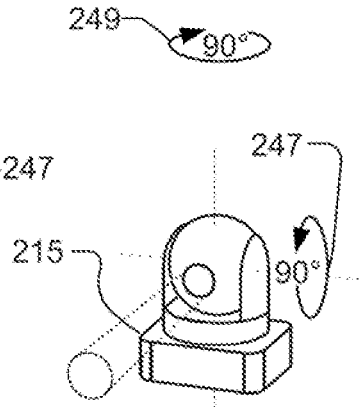
Figure 4G:
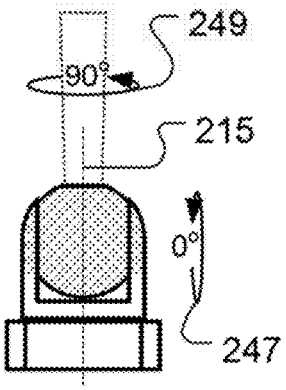
Figure 4H:
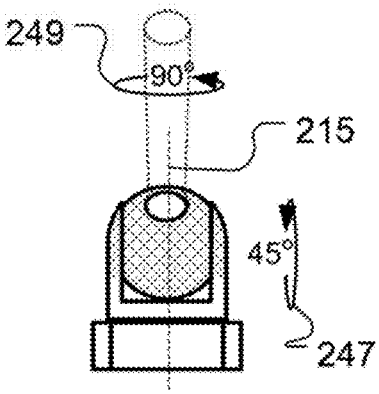
Figure 4I:
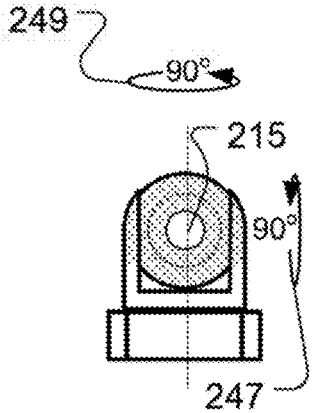

FIGS. 2*g*-2*i*; 3*g*-3*i* and 4*g*-4*i* illustrate the moving head light fixture with the yoke arranged at an yoke angle of 90 degrees and the head at different head angles, where in FIGS. 2*g*, 3*g* and 4*g* the head is positioned at a head angle of 0 degrees; in FIGS. 2*h*, 3*h* and 4*h* the head is positioned at a head angle of 45 degrees and in FIGS. 2*i*, 3*i* and 4*i* the head are positioned at a head angle of 90 degrees.

FIGS. 2*a*-2*i*, 3*a*-3*i*, 4*a*-4*i* illustrate that a viewer observing the illuminating part of the moving head light fixture will see that the illuminating part as a static pixel independent of the yoke and head positions, as by only observing the illuminating parts it will be very difficult to determine the position of the head and yoke. It is noticed that the emitting window 217 also can be illuminated by pixel light sources which reduces the effect that the position emitting window may be observed by a viewer at different positions of the moving head light fixture. Alternatively the beam light source can used to illuminate the emitting window for instance by dimming the light beam to the same intensity and color as the same intensity as the illuminating parts. It is noticed that the position of the emitting window and light beam will be visible when the light beam is turned on with bright intensity, however this effect can be used to generate additional light effects.

FIGS. 5*a*-5*e* illustrate perspective views of a plurality of moving head light fixtures 201 forming a graphical display 500. The moving head light fixtures are similar to the light fixture illustrated in FIGS. 2-4 and have been arranged in a 10×10 matrix. However it is noticed the graphical display can be provided by arranging number of moving head light fixtures in any arbitrary shaped such as rectangular, circular, polygonal and or even in three dimensional patterns. Each of the moving head light fixtures represents a single pixel of the graphical display. The moving heads can be arranged in regular intervals in relation to each other in order provide to a regular pixel density. However it is also possible to arrange the moving heads at varying distances in relation to each other whereby it is possible to provide a different appearance of the group of moving heads.

Figure 5A:
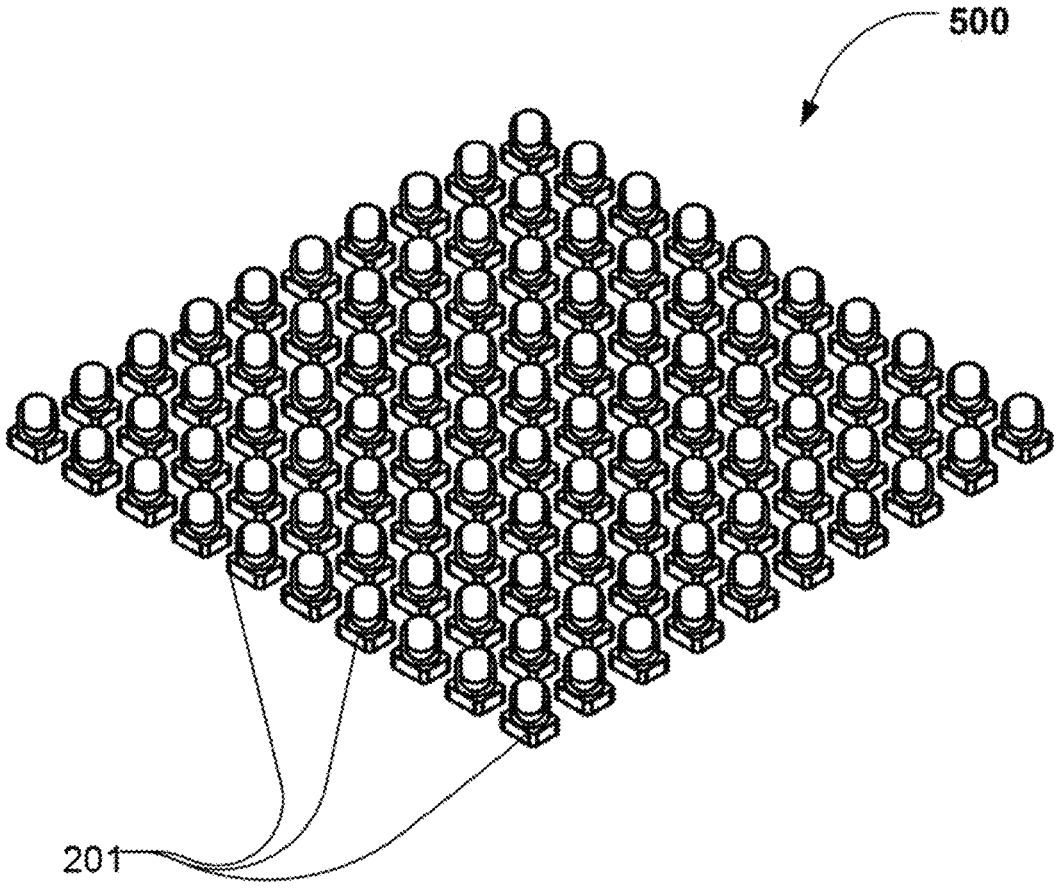
FIGS. 5*a*-5*e* illustrate perspective views of a plurality of moving head light fixtures forming a graphical display crating different light and visual effects.

In FIG. 5*a* all the moving head light fixtures of the graphical display are arrange in a setting with a head position of 0 degrees and a yoke position of 45 degrees. Both the light beam source and the pixel source of each moving head light fixture have been turned off.

Figure 5B:
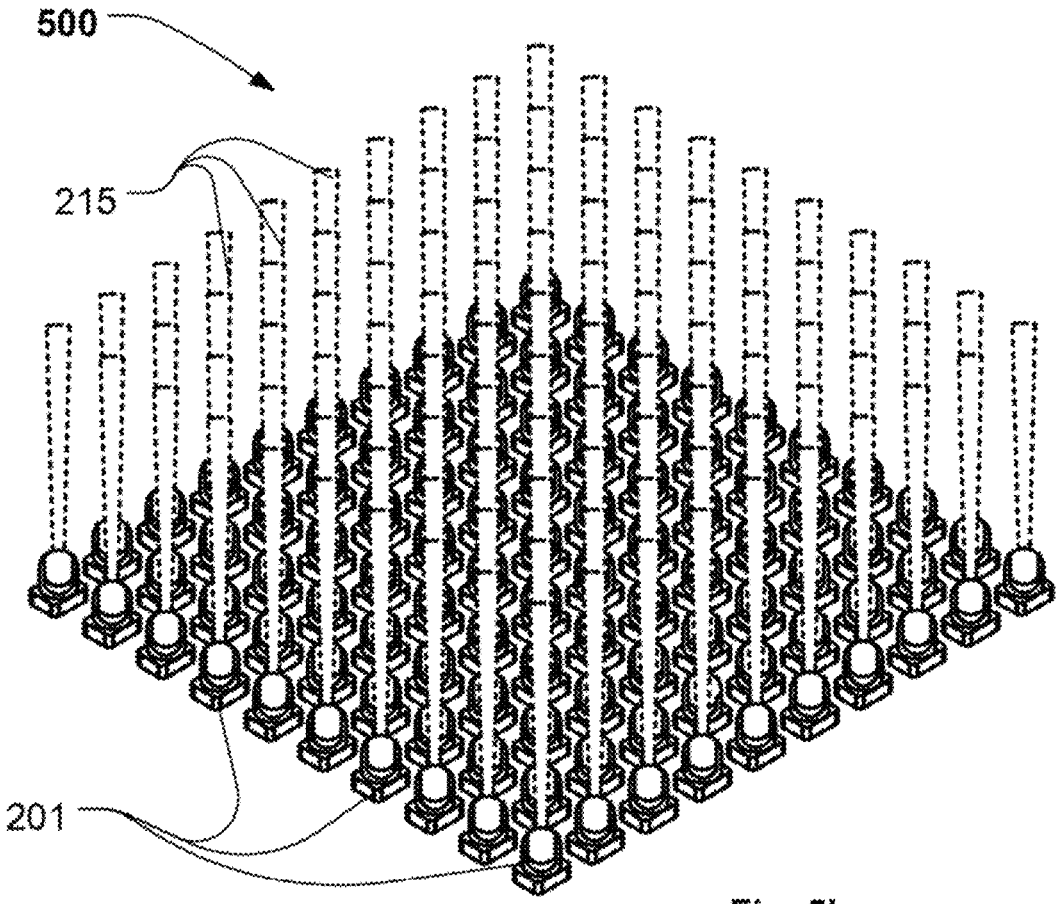
Figure 5C:
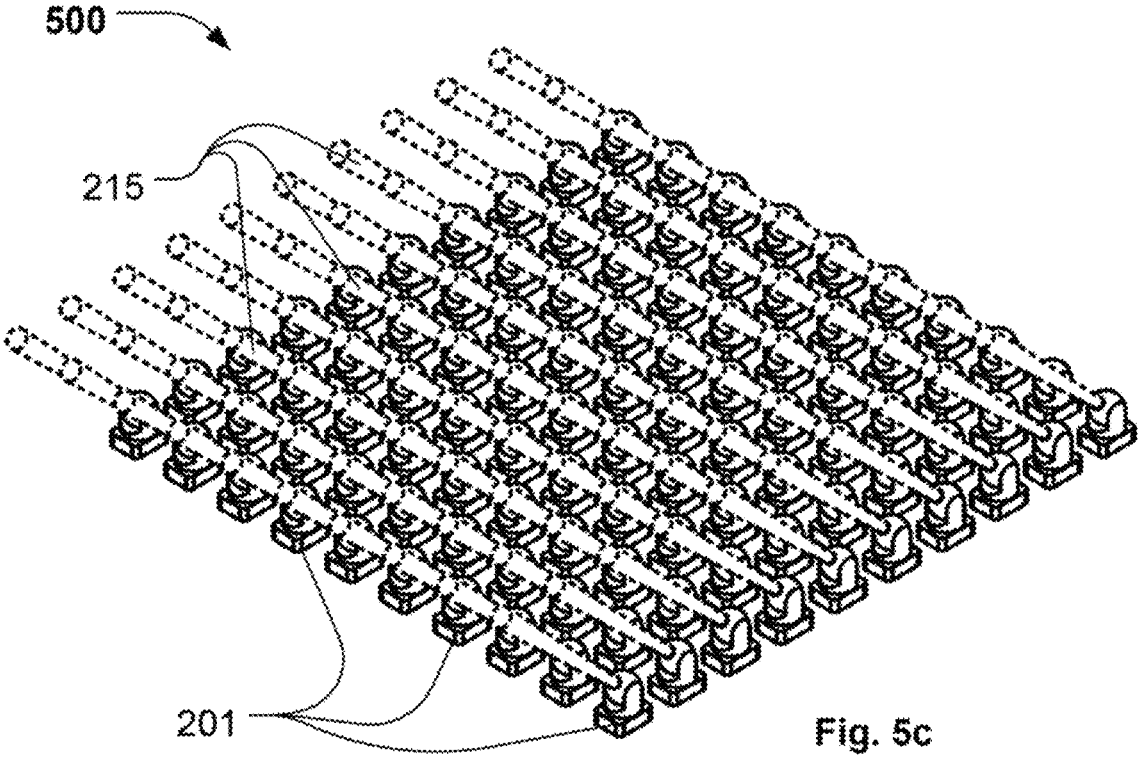

In FIG. 5*b* all the moving head light fixtures of the graphical display are arranged in a setting with a head position of 0 degrees and a yoke position of 45 degrees. The light beam source is turned on and the moving head light fixtures generate a plurality of light beams 215 while the pixel source of each moving head light fixture has been turned off.

Figure 5D:
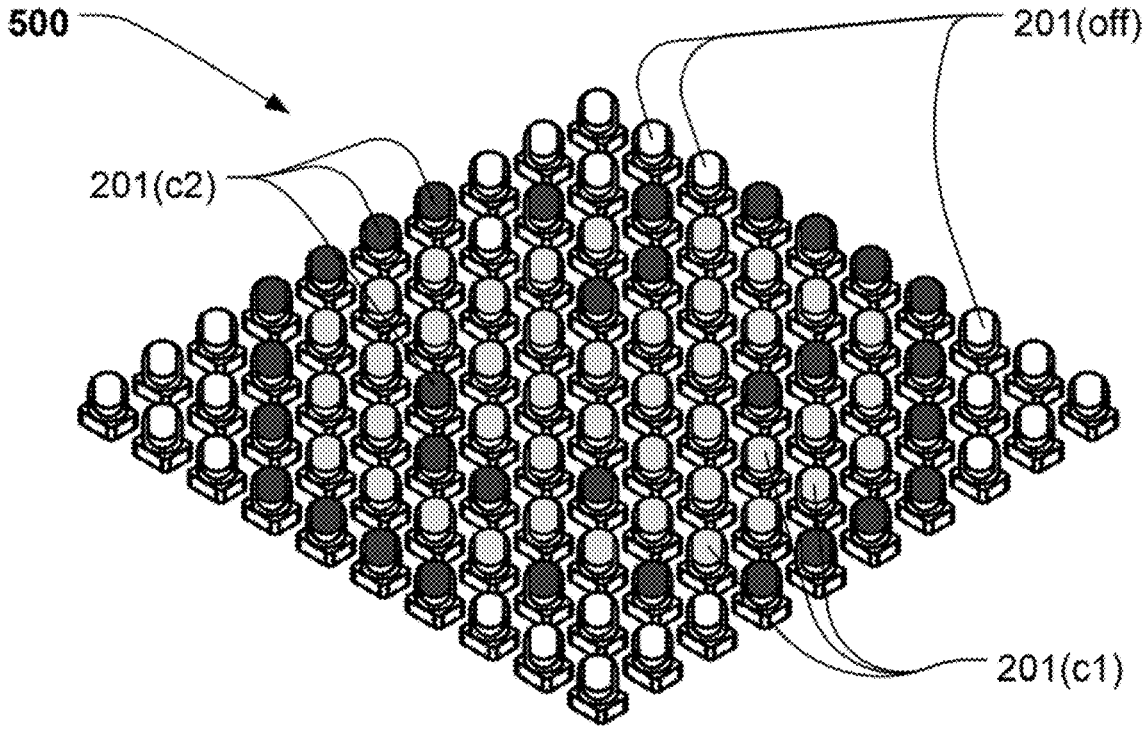
Figure 5E:
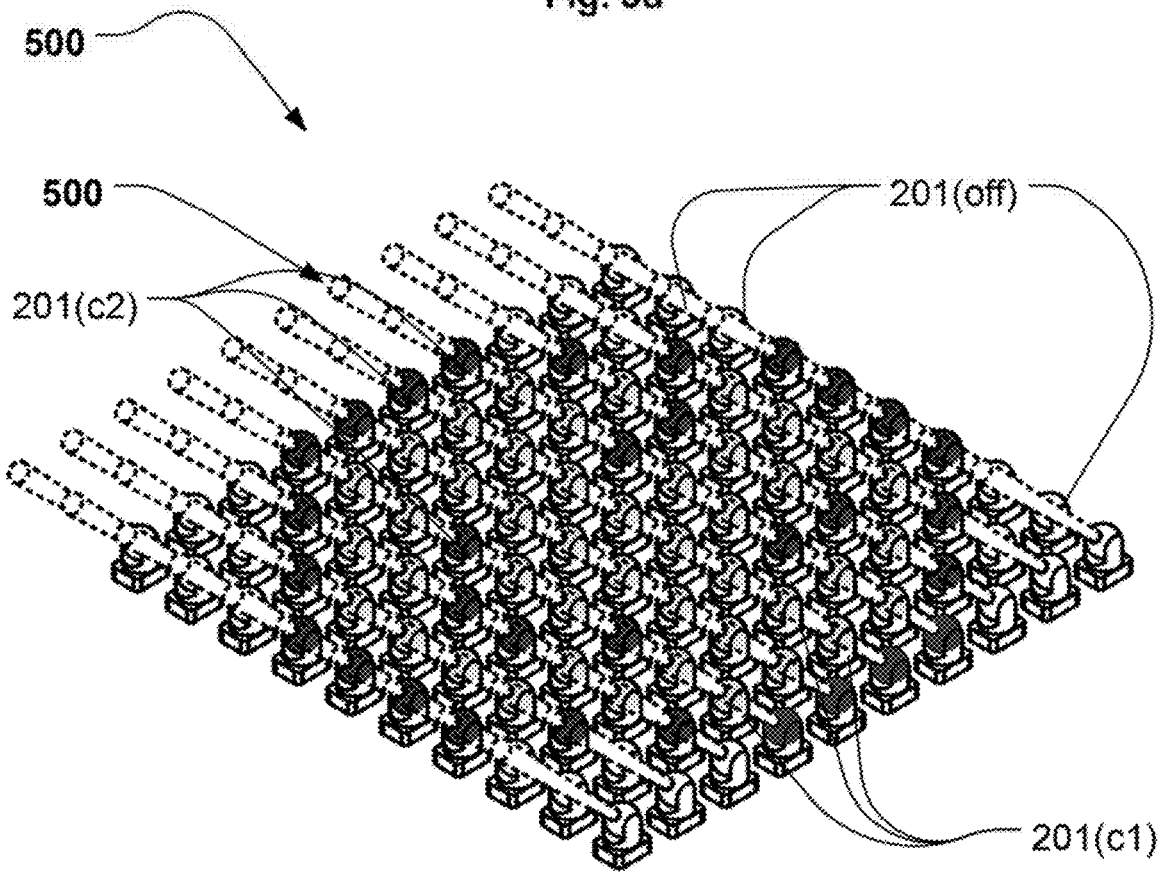

In FIG. 5*e* all the moving head light fixtures of the graphical display are arranged in a setting with a head position of 45 degrees and a yoke position of 45° degrees. Both the bead and yoke have thus been rotated 45 degrees in relation to the positions in FIG. 5*b*. The light beam source is turned on and the moving head light fixtures generate a plurality of light beams 215 while the pixel source of each moving head light fixture has been turned off.

In FIG. 5*d* all the moving head light fixtures of the graphical display are arrange in a setting with a head position of 0 degrees and a yoke position of 45 degrees corresponding to the positions in FIGS. 5*a* and 5*b*. The light beam sources of the moving head light fixtures are turned off and a graphical image is created at the graphical display by turning the pixel light sources of some of the moving head light fixtures on. Some of the moving head light fixtures do not have their pixel sources activated 201 (off) (white shading), some of the moving head light fixtures have their pixel sources activated in a first color 201(*c*1) (light gray shading), and some of the moving head light fixtures have their pixel sources activated in a second color 201(*c*2)(dark gray shading).

In FIG. 5*e* the graphical display displays the same images as in FIG. 5*d* and the moving head light fixtures have been moved to a setting with a head position of 45 degrees and a yoke position of 45 degrees corresponding to the positions in fig, Sc. Additionally the light beam sources have been turned on and a plurality of light beams is thus emitted by moving head light fixtures, as a consequence a combination of a graphical image created by the pixel light: source and midair effects created by the light beam is provided. As described earlier due to the substantial rotational symmetric shape of the illuminating parts of the head housing and yoke shell in relation the yoke axis, the moving head light fixtures can be rotated around the yoke axis without distorting the pixels, and due to the substantial rotation symmetric shape of the illuminating parts of the head in relation to the head axis it is possible to rotate the head around the head axis without distorting the pixels of the graphical image.

In FIGS. 5*a*-5*e* all of the moving head light fixtures are facing the same direction however it should be noticed that the direction of the moving head light fixtures can be different for each individual lighting fixture and the image produced by the moving head lighting fixtures does still not appear distorted.

Figure 6A:
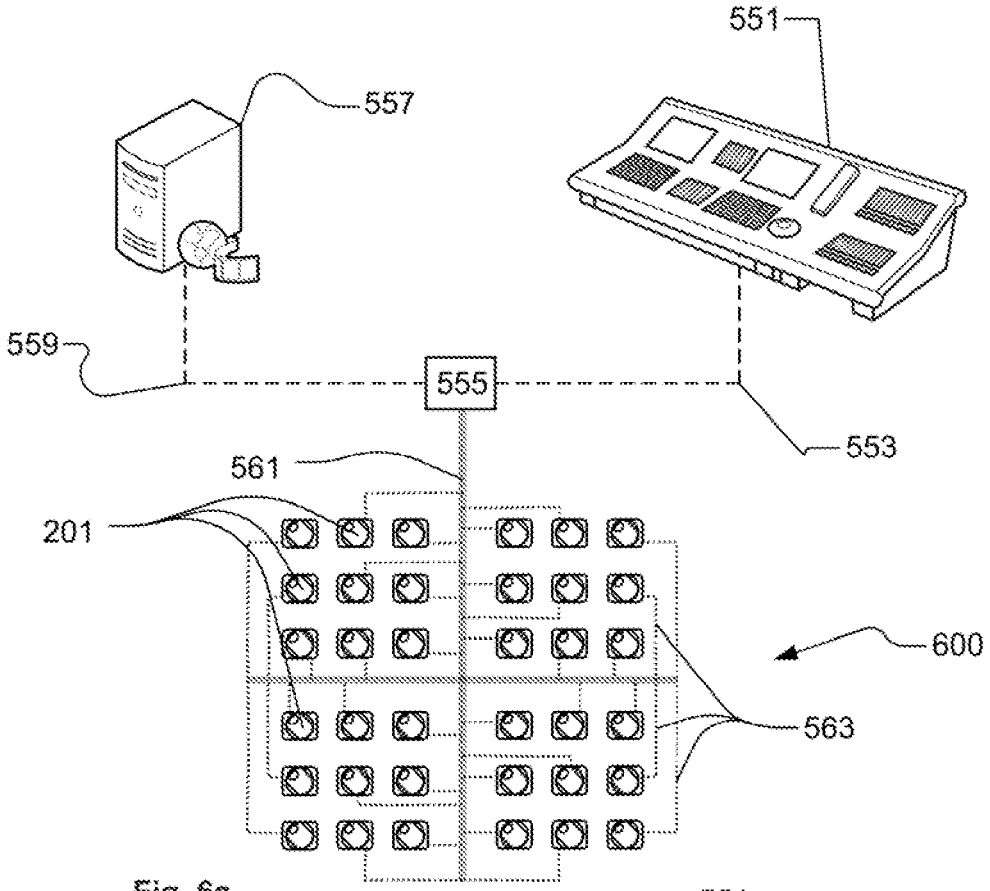
FIGS. 6*a*-6*b* illustrate structural diagrams of different graphical display systems comprising a plurality of the moving head light fixtures.
Figure 6B:
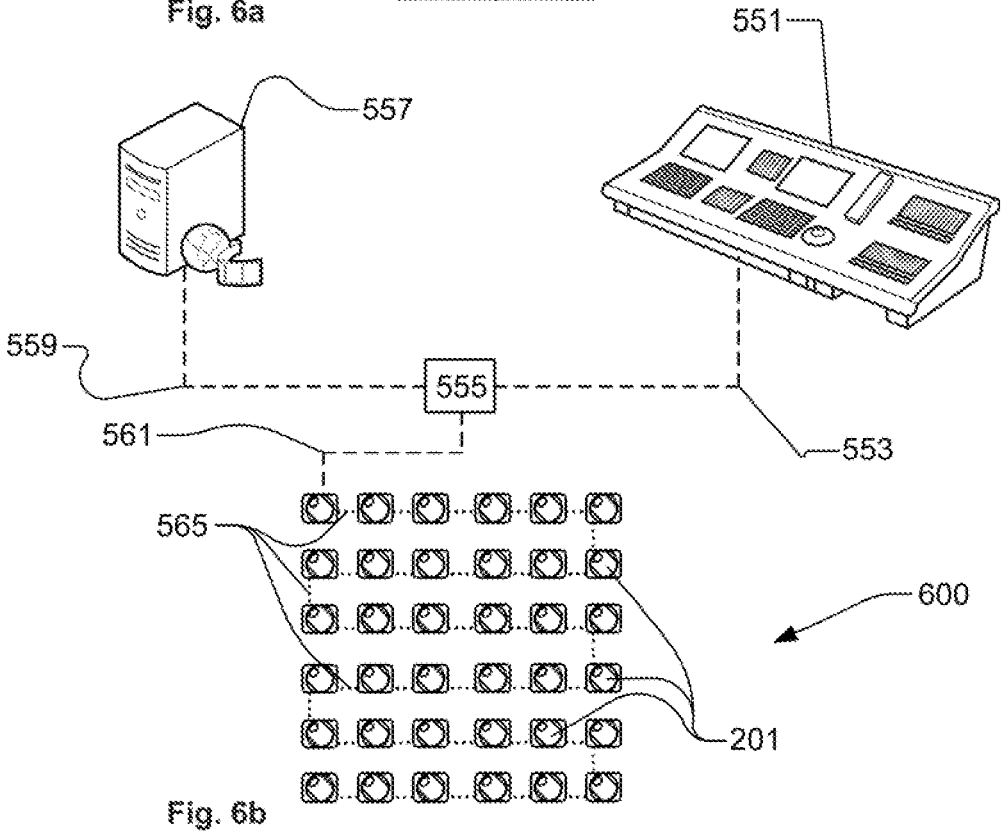

FIGS. 6*a*-*b* illustrates block diagrams of a graphical display system comprising a graphical display 600 comprising a plurality of moving head light fixtures 201 according to the present inventions. The graphical system comprises a control system where a light controller 551 is configured to send light effect parameters to the light fixtures, such as beam effect parameters, position effect parameters through a signal line 553 to an interface 555 which distributes the light effect parameters to each moving head light fixture 201. The controller can use any data protocol like DMX, ArtNet, Ethernet, RDM, etc. and the signal line 553 can both be wired or wireless.

The control system comprises a pixel data controller configured to send pixel data through a signal line 559 to the interface 555. The pixel data can be any kind of video and picture format like JPEG, PNG, GIF, MPEG, AVI etc. and the signal line can both be wired or wireless. The pixel data controller can for instance be provided as a media server.

The interface 555 can be implemented as a separate device as shown in this embodiment or it can be implemented directly into the moving head lighting fixtures 201. The interface merges the signal from the light controller 551 and the pixel controller 557 and it distributes the pixel data to the individual moving head light fixtures 201. The merged signal 561 can either be a complete signal indicative of exactly how the individual lighting fixtures should behave or the merged signal 561 can comprise a media feed with data from the light controller indicative of some post processing that the individual lighting fixtures needs to perform. One of the advantages gained from post processing could be higher performance at fixture level since the throughput of the merged signal usually is tied up to the frame rate of the media for instance 24 Hz.

In FIG. 6*a* each of the moving head lighting fixtures 201 are connected individually to the interface 555 using separate signal lines 563 bundled together into a main signal line. The interface can then distribute pixel data directly to the individual lighting fixtures.

In FIG. 6*b* the moving head lighting fixtures 201 are daisy chained using signal lines 565 between the individual light fixtures and then connected to the interface 555 through a common signal line 561. In this embodiment the interface attaches an address to the pixel data and the addresses correspond to the individual lighting fixtures; that way the lighting fixtures only visualize pixel data with their own address attached to it.

The embodiments in FIGS. 6*a*-6*b* are only illustrating examples and the skilled person within the area of intelligent and entertainment lighting will be able to connect the lighting system in several other ways. For instance it is possible to integrate the light controller and pixel controller into one common device functioning both as pixel controller and light controller. Additionally the input signal 553 indicative of the light effect parameters and input signal 559 indicative of the pixel parameter can be feed to moving head light fixtures as two separate input signals. Also the input signals can be transferred using wireless communication protocols such as WIFI, Bluetooth etc.

Figure 7:
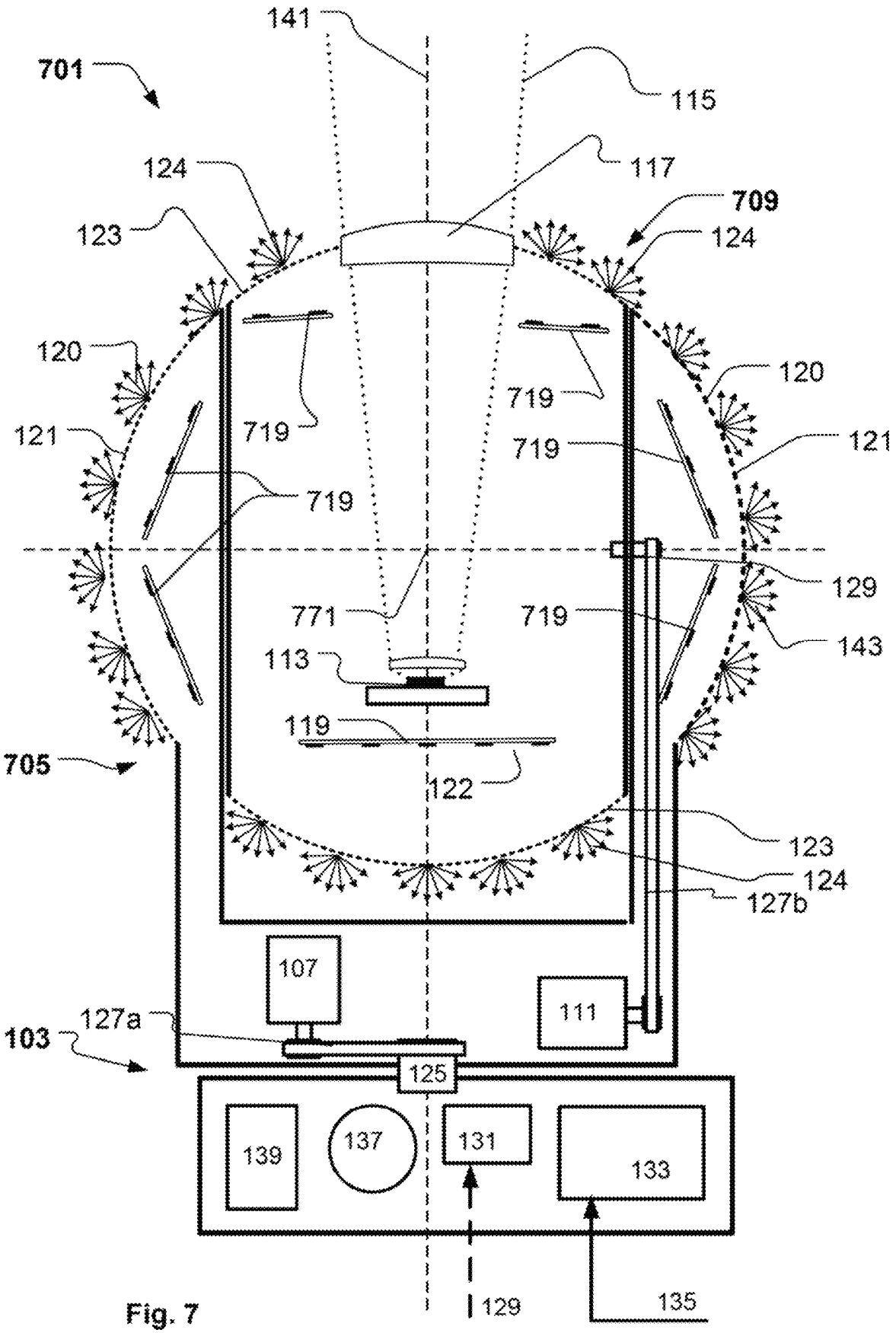
FIG. 7 illustrates a site cross-sectional view of a moving head light fixture with a beam light source, a pixel light source and illuminating parts.

FIG. 7 illustrates a structural diagram of a moving head light fixture 701 comprising a base 103, a yoke 705 and a head 709. The moving head light is similar to the moving head light fixture 101 illustrated in FIG. 1. Identical components have been given the same reference numbers as in FIG. 1 and will not be described further. In this embodiment the pixel light sources 719 have been provided as number of PCB (printed circuit boards) comprising a number of RGB LEDs which can illuminate different parts of the transparent part of the head housing 123 and different part of the yoke housing 121. This makes it possible to provide a uniform illumination of the illuminating parts which also can be illuminated by many different colors. In alternative embodiments the light sources can also be provided as RGBW LEDs or multi-die LEDs having other colors.

The transparent illuminating part of the head housing 709 is shaped as a spherical segment having center point at the intersection 771 between the head axis and the yoke axis and the transparent illuminating parts of the yoke arms are shaped a spherical cap having center point at the intersection 771 between the head axis and the yoke axis. The spherical segment of the head housing and spherical cap of the yoke arms have the same radius. As a consequence, the illuminating parts of head and yoke arms form a substantial sphere which is illuminated by the pixel light sources 719. The illuminating parts will thus appear as a uniform sphere independent of the position of the head in relation the head axis and the position of the yoke in relation to the yoke axis.

Figure 8:
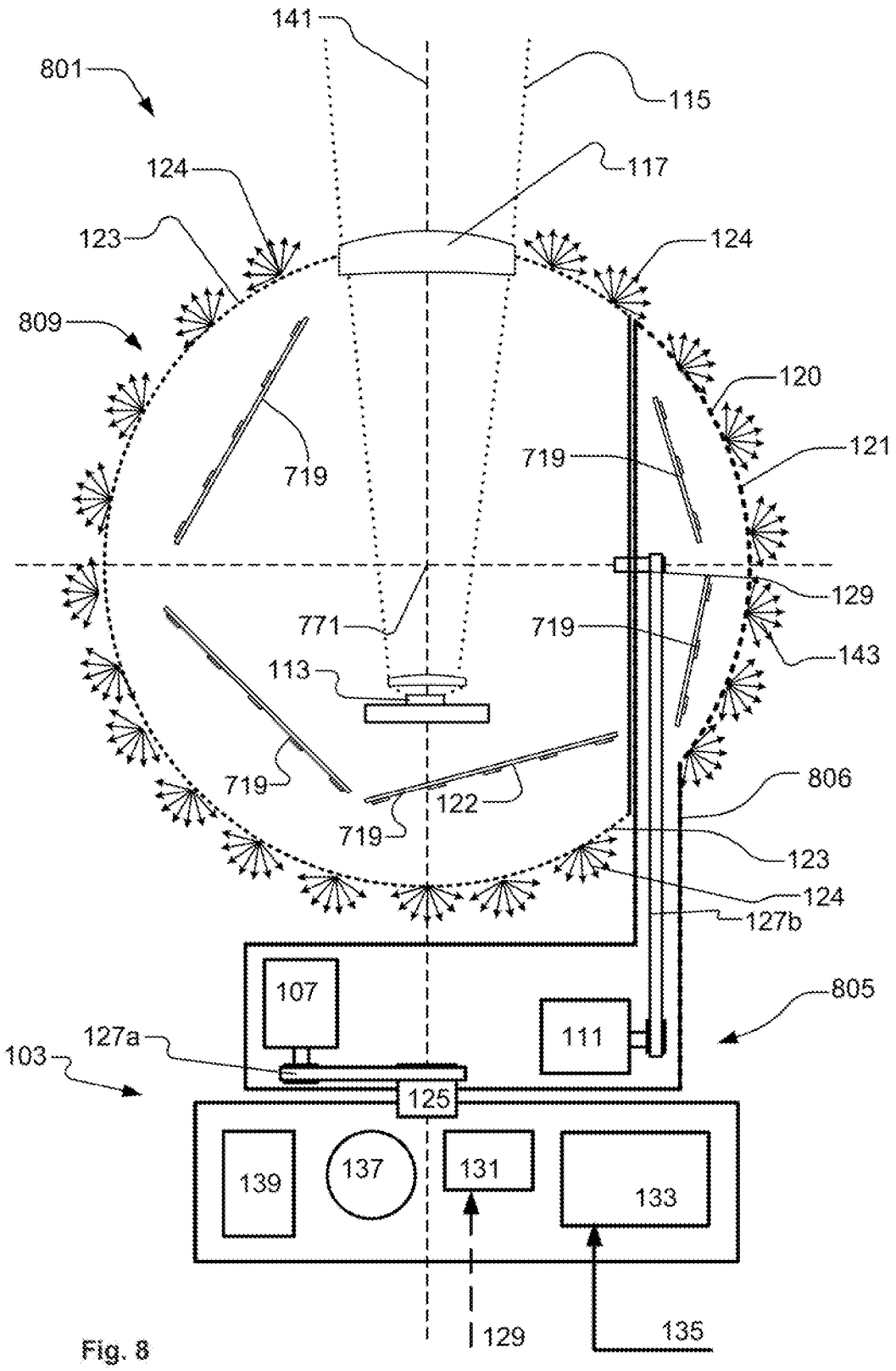
FIG. 8 illustrates a simplified cross-sectional view of a moving head light fixture with a beam light source, a pixel light source and illuminating parts.

FIG. 8 illustrates a structural diagram of a moving head light fixture 801 comprising a base 103, a yoke 805 and a head 809. The moving head light fixture is similar to the moving head light fixture 701 illustrated in FIG. 7. Identical components have been given the same reference numbers as in FIG. 7 and will not be described further.

In this embodiment the yoke is formed as a one-armed yoke comprising one yoke arm 806 carrying the head 809.

The transparent illuminating part of the head housing 809 is shaped as a spherical boule/ball having center point at the intersection 771 between the head axis and the yoke axis and the transparent illuminating parts of the yoke arm is shaped a spherical cap having center point at the intersection 771 between the head axis and the yoke axis. The spherical boule/ball of the head housing and spherical cap of the yoke arms has the same radius. As a consequence the illuminating parts of head and yoke arm form a substantial sphere which is illuminated by the pixel light sources 719. The illuminating parts will thus appear as a uniform illuminating sphere independent of the position of the head in relation the head axis and the position of the yoke in relation to the yoke axis.

Throughout the figures the pixel light sources illuminating the head housing have been arranged in the head, however it is noticed that it also is possible to arrange the pixel light sources illuminating head housing in the yoke, for instance by arranging the pixel light source near the junction between the head and yoke and arrange the pixel light sources such that a part of the light will be transmitted through the junction and into the head where it can illuminate the head housing. It is also possible to provide the parts of the head housing and the parts of the yoke shell that faces other in transparent material allowing light from the pixel light sources arranged in the yoke to be emitted into the head where it can illuminate the head housing. Alternatively the light from a pixel light source in the head can also be emitted to the yoke through openings in the parts of the head and yoke which face each other. Likewise the pixel light sources illuminating the yoke shell also can be arranged in the head where the light can be emitted from the head and into the yoke where it illuminate the yoke shell.

The invention claimed is:

1. A moving head light fixture comprising:

a base;

a yoke rotatable connected to said base, where at least one actuator rotates said yoke around a yoke axis, said yoke comprises at least one yoke shell configured to enclose at least one yoke element;

a head rotatably connected to said yoke, where at least one actuator rotates said head around a head axis, said head comprises at least one beam light source arranged in a head housing, said beam light source generating a light beam exiting said head housing through a light beam window in said head housing;

wherein said moving head light fixture comprises at least one pixel light source configured to illuminate at least one of:

a part of the inside of said head housing; and a part of the inside of said yoke shell;

the parts of said head housing and said yoke shell that are illuminated by said pixel light source form an illuminating part formed in a transparent material allowing light from said pixel light source to pass through said illuminating part and said illuminating part is substantially rotationally symmetric in relation to said yoke axis and said head axis.

2. The moving head light fixture according to claim 1 wherein said, illuminating part formed in said head housing is substantially rotationally symmetric in relation to said head axis.

3. The moving head light fixture according to claim 1, wherein the outer surface of said illuminating part of said head housing and yoke shell form a continuous surface.

4. The moving head light fixture according to claim 1, wherein at least a part of said illuminating part is shaped as part of a sphere, where the center point of said sphere is coincident with said yoke axis.

5. The moving head light fixture according to claim 1, wherein at least a part of said illuminating part is shaped as part of a sphere, where the center point of said sphere is coincident with said head axis.

6. The moving head light fixture according to claim 1, wherein said yoke axis and said head axis are perpendicular and at least a part of said illuminating part is shaped as part of a sphere, where the center point of said sphere is coincident with the intersection between said head axis and said yoke axis.

7. The moving head light fixture according to claim 1, wherein said illuminating part is configured to scatter light received from said pixel light sources into many directions outside said illuminating part.

8. The moving head light fixture according to claim 1, wherein said transparent material comprises a frosted region.

9. The moving head light fixture according to claim 1, wherein said pixel light source comprises at least a red emitter configured to emit red light, a green emitter configured to emit green light and a blue Miner configured to emit blue light.

10. A graphical display system comprising:

a plurality of illuminating pixels; and a control system configured to send pixel data to said plurality of illuminating pixel, said pixel data indicates the color of each of said illuminating pixels, wherein said illuminating pixels are provided as a moving head light and wherein said pixel light source of said moving head light fixture is controlled based on said pixel data;

said moving head light fixture having:

a base;

a yoke rotatable connected to said base, where at least one actuator rotates said yoke around a yoke axis, said yoke comprises at least one yoke shell configured to enclose at least one yoke element;

a head rotatably connected to said yoke, where at least one actuator rotates said head around a head axis, said head comprises at least one beam light source arranged in a head housing, said beam light source generating a light beam exiting said head housing through a light beam window in said head housing, wherein said moving head light fixture comprises at least one pixel light source configured to illuminate at least one of:

a part of the inside of said head housing; and a part of the inside of said yoke shell;

the parts of said head housing and said yoke shell that are illuminated by said pixel light source form an illuminating part formed in a transparent material allowing light from said pixel light source to pass through said illuminating part and said illuminating part is substantially rotationally symmetric in relation to said yoke axis and said head axis.

11. The graphical display system according to claim 10 wherein said control system is configured to send light effect parameters indicative of at least one beam effect parameter related to said light beam and at least one position parameter related to at least one of the position of said head in relation to said base and the position of said yoke in relation to said base.

12. The graphical display system according to claim 11 wherein said control system comprises a pixel controller configured to generate said pixel data and a light controller configured to generate said beam effect parameter and said position parameter.

13. A method of providing a visual effect said method comprises at least one of the following steps:

illuminating a part of the inside of a head housing of a moving head light fixture using a pixel light source; and illuminating a part of the inside of a yoke shell of a moving head light fixture using a pixel light source;

where said moving bead head light fixture comprises:

a base;

a yoke rotatably connected to said base, said yoke is rotatable around a yoke axis and comprises said yoke shell; and a head rotatably connected to said yoke, said head is rotatable around a head axis and comprises at least one beam light source arranged in said head housing, said beam light source generating a light beam exiting said head housing through a light beam window in said head housing;

the parts of said head housing and said yoke shell that are illuminated by said pixel light source form an illuminating part formed in a transparent material allowing light from said pixel light source to pass through said illuminating part and said illuminating part formed in said head housing is substantially rotationally symmetric in relation to said yoke axis and said head axis.

14. The method according to claim 13 comprising a step of venerating midair light effects in the air outside said moving head light fixture using said light beam light source.

15. The method according to claim 13 comprising at least one of the steps of:

rotating said head around said head axis using an actuator; and rotating said yoke around said yoke axis using an actuator.

16. The method according to claim 13 comprising a step of providing a plurality of said moving heads light fixtures and for at least some of said moving heads light fixture performing at least one of the steps of:

illuminating a part of the inside of said head housing of a moving head light fixture using a pixel light source; and illuminating a part of the inside of said yoke shell of a moving head light fixture using a pixel light source;

generating midair in the air outside said moving head light fixture using, said light beam light source;

rotating said head around said head axis using an actuator; and rotating said yoke around said yoke axis using an actuator.

* * * * *